US006578228B2

(12) United States Patent
Yehia

(10) Patent No.: US 6,578,228 B2
(45) Date of Patent: Jun. 17, 2003

(54) PIPE END PREPARATION TOOL

(75) Inventor: Victor Yehia, West Vancouver (CA)

(73) Assignee: Copper Key International Ltd., West Vancouver (CA)

( * ) Notice: Subject to any disclaimer, the term of this patent is extended or adjusted under 35 U.S.C. 154(b) by 0 days.

(21) Appl. No.: 10/046,382

(22) Filed: Mar. 18, 2002

(65) Prior Publication Data

US 2002/0095735 A1 Jul. 25, 2002

Related U.S. Application Data

(63) Continuation of application No. PCT/CA00/00837, filed on Jul. 17, 2000.

(30) Foreign Application Priority Data

Jul. 16, 1999 (CA) ..... 2277525

(51) Int. Cl.[7] ..... A47L 13/40
(52) U.S. Cl. ..... 15/104
(58) Field of Search ..... 15/104.03, 104.04, 15/104.05, 104.09, 106, 206, 160

(56) References Cited

U.S. PATENT DOCUMENTS 2,383,464 A 8/1945 Bown
4,133,070 A * 1/1979 Litt
4,862,549 A * 9/1989 Criswell et al.
4,899,409 A * 2/1990 Cox
5,056,265 A * 10/1991 Hurst
5,058,327 A 10/1991 Buchanan
5,168,660 A * 12/1992 Smith
5,269,104 A 12/1993 DiBiagio
5,493,748 A * 2/1996 Santo
5,566,416 A * 10/1996 Karls
5,791,005 A * 8/1998 Grabowski et al.
5,809,601 A * 9/1998 Rivera
6,393,645 B1 * 5/2002 Kadinger

FOREIGN PATENT DOCUMENTS

GB 2241450 A 4/1991

* cited by examiner

*Primary Examiner*—Terrence R. Till
(74) *Attorney, Agent, or Firm*—Paul A. Guss

(57) ABSTRACT

A hand tool (5) is provided wherein a pipe engages a female (20) or male brush (30) at one end (10*d*) of the tool and the other end (10*c*) has a grippable member (15, 16) that allows a rotation bicycling motion to permit the easy cleaning of the pipe end. Variations include a hinge between such ends to allow cleaning the pipe end at an angle or a ratchet version.

20 Claims, 6 Drawing Sheets

24
60
61
20

31
30
110
71
110
70

71
110

10
80

10b
110
100
10

PIPE END PREPARATION TOOL

This application is a continuation in part of international application number PCT CA00 00837, filed Jul. 17, 2000.

FIELD OF INVENTION

This invention relates to tools for cleaning pipes for soldering.

BACKGROUND OF INVENTION

Relevant prior art includes U.S. Pat. Nos. 4,133,070; 5,566,416; 5,146,717; Canadian Patent 1072709; U.S. Pat. No. 2,383,464A; Soviet Union Patent 1077-668A; U.S. Pat. No. 5,269,104A, and Great Britain Patent 2241450A.

STATEMENT OF INVENTION

There is provided a hand tool for cleaning the end of a pipe comprising: (a) a longitudinal member having first and second opposed end portions and first and second opposed longitudinal sides; (b) first and second grippable members both rotatably connected to said first end portion on said first and said second longitudinal sides respectively; (c) a first cleaning means connected to said second end portion on said first longitudinal side, and a second cleaning means connected to said second end portion on said second longitudinal side, for receiving the pipe end in a direction transverse to said longitudinal member and for cleaning inside and outside surface of the pipe end respectively.

BRIEF DESCRIPTION OF DRAWINGS

Advantages of the present invention will become apparent from the following detailed description taken in conjunction with preferred embodiments shown in the accompanying drawings, in which:

FIG. 8(*a*) is a partial sectional view of another embodiment of the female brush of the tool;

FIG. 8(*b*) is a partial sectional view of another embodiment of the male brush of the tool;

FIG. 8(*c*) is a top plan view of another embodiment of the male brush of the tool;

FIG. 11(*b*) is a partial sectional view of another embodiment of the male brush of the tool;

DETAILED DESCRIPTION OF THE PREFERRED EMBODIMENTS

Figure 1:
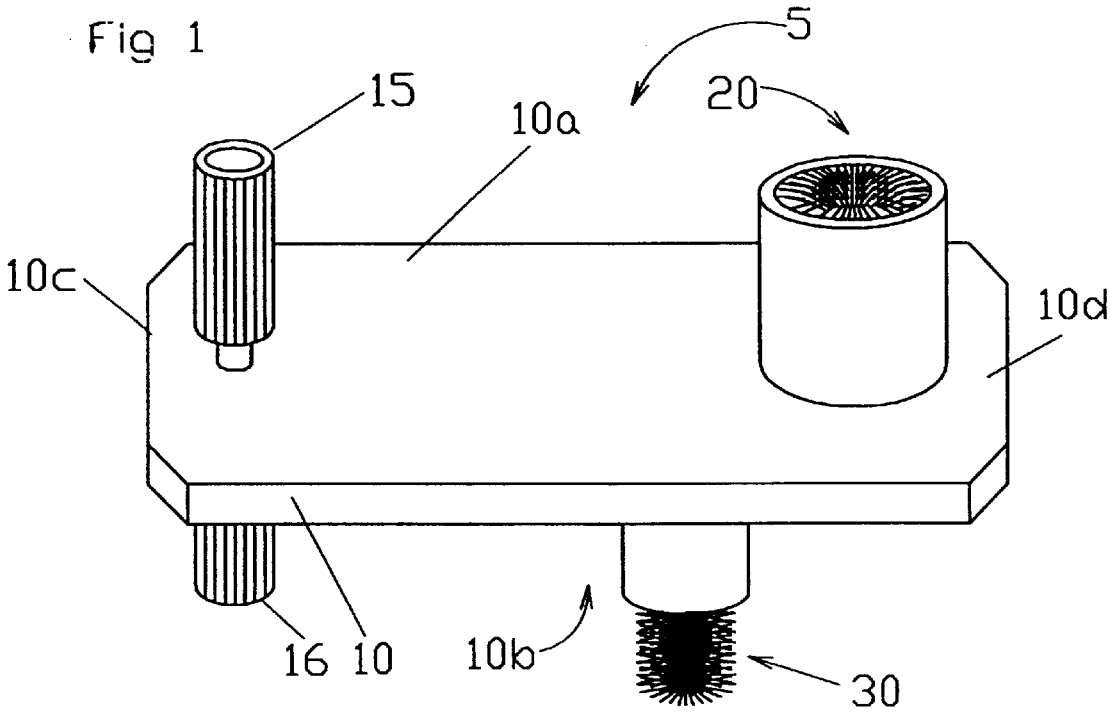
FIG. 1 is a front perspective view of the tool.
Figure 2:
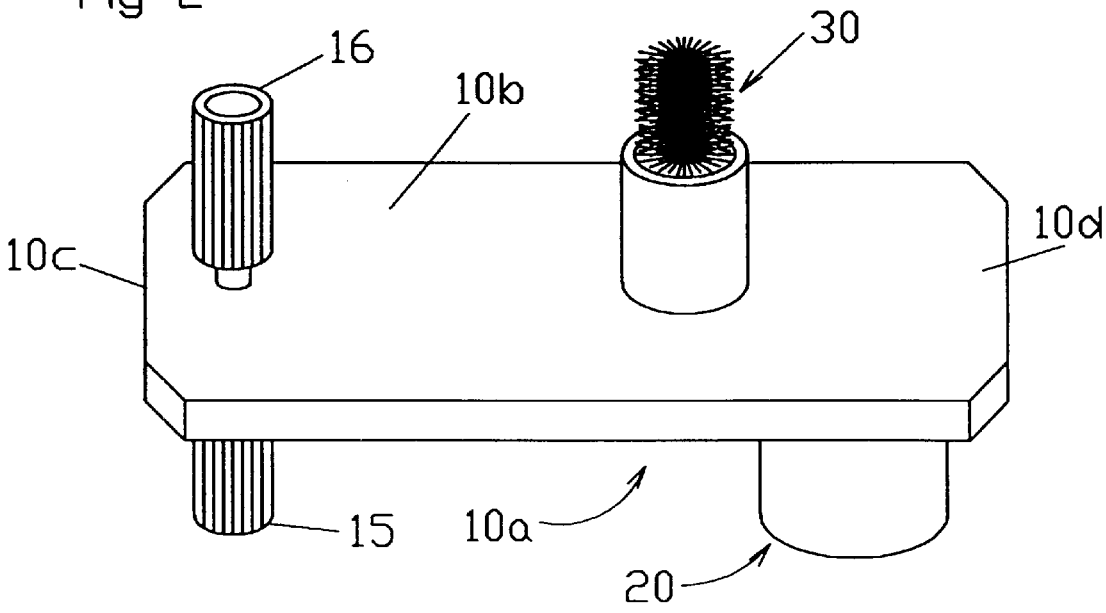
FIG. 2 is a perspective view of the tool of FIG. 1 rotated upside down.
Figure 3:
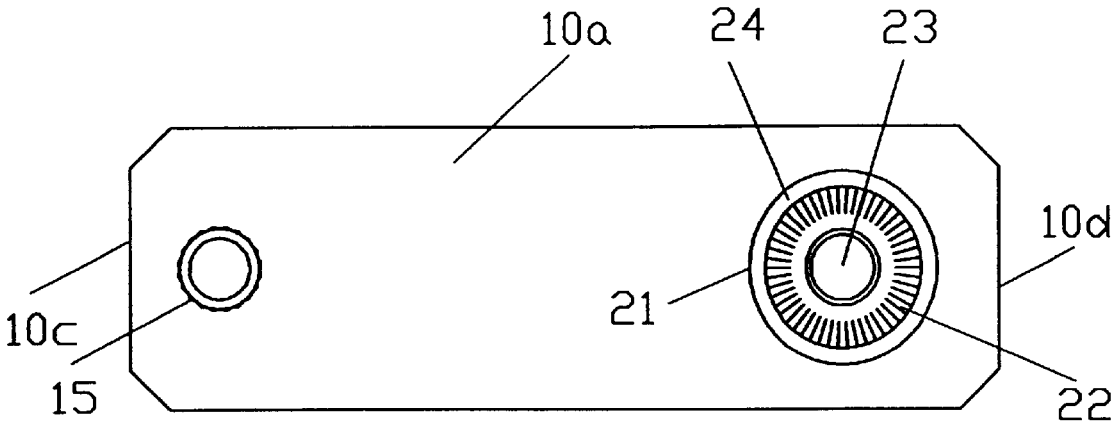
FIG. 3 is the top plan view of the tool of FIG. 1.
Figure 4:
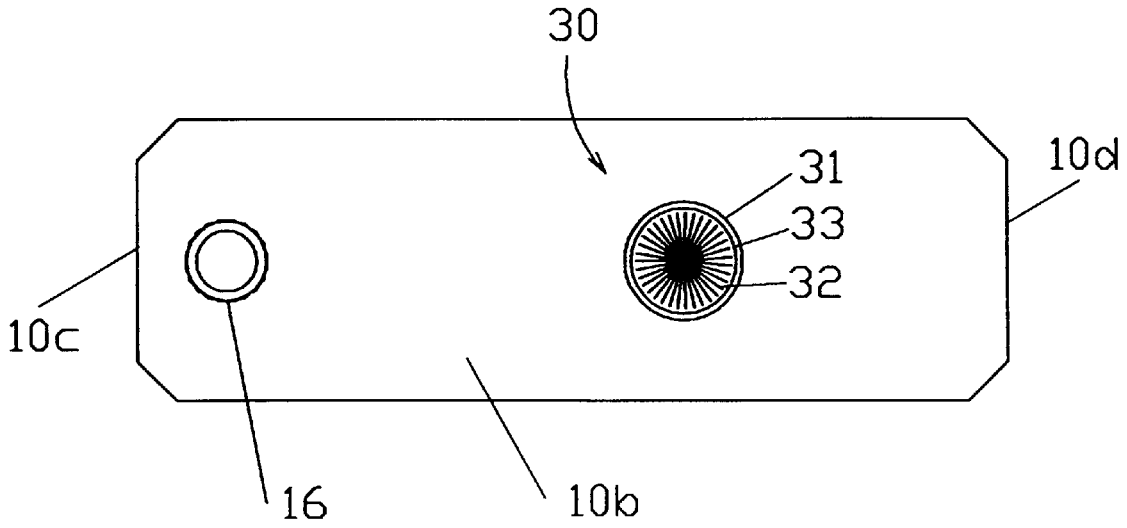
FIG. 4 is the bottom plan view of the tool of FIG. 1.

Herein, the term "pipe end" includes not only the end of a metallic pipe but also the end of a pipe connector (which is typically much shorter than the pipes it connects to).

Hand tool 5 has rigid member 10 which has two opposed sides 10*a* and 10*b*, and opposed end portions 10*c* and 10*d*. Side 10*a* at end portion 10*c* has rotatably attached member 15 to be gripped by the fingers of one hand. On the opposed side 10*b*, at end portion 10*d*, male hard brush 30 is rigidly and undetachably disposed for receiving pipe end 1. One hand holds tool 5. Pipe end 1 is inserted over male brush 30 so that it abuts pedestal 31 (explained in detail below in conjunction with FIG. 5) and is disposed in a snug friction fit therewith and is held by the other hand. The inner surface of pipe end 1 is cleaned by a pedalling motion. One pedalling motion is achieved by gripping rotatable member 15 and holding end portion 10*c* stationary with one hand while rotating, with the other hand, pipe end 1 fitted over male brush 30, about end portion 10*c*. Another pedalling motion is achieved by gripping rotatable member 15 and moving end portion 10*c* with one hand, and gripping pipe end 1 fitted over male brush 30, with the other hand, and moving end portion 10*c* and pipe end 1 about each other. Either way, the effect of the pedalling motion is that male brush 30 will rotationally scrape and clean the inner surface of pipe end 1.

Similarly, on side 10*b* and at end portion 10*c*, rotatable member 16 is gripped by the fingers of one hand; and on the opposed side 10*b* and end portion 10*d*, there is rigidly and undetachably disposed female brush 20.

Brushes 20 and 30 are rigidly and undetachably attached to member 10 by conventional means such as bolts, soldering and the like (not shown). Alternatively, brushes 20 and 30 may be detachably attached to member 10 by conventional threaded mounting (brush 20 would be threaded to engage a corresponding threaded socket in member 10, not shown).

Figure 5:
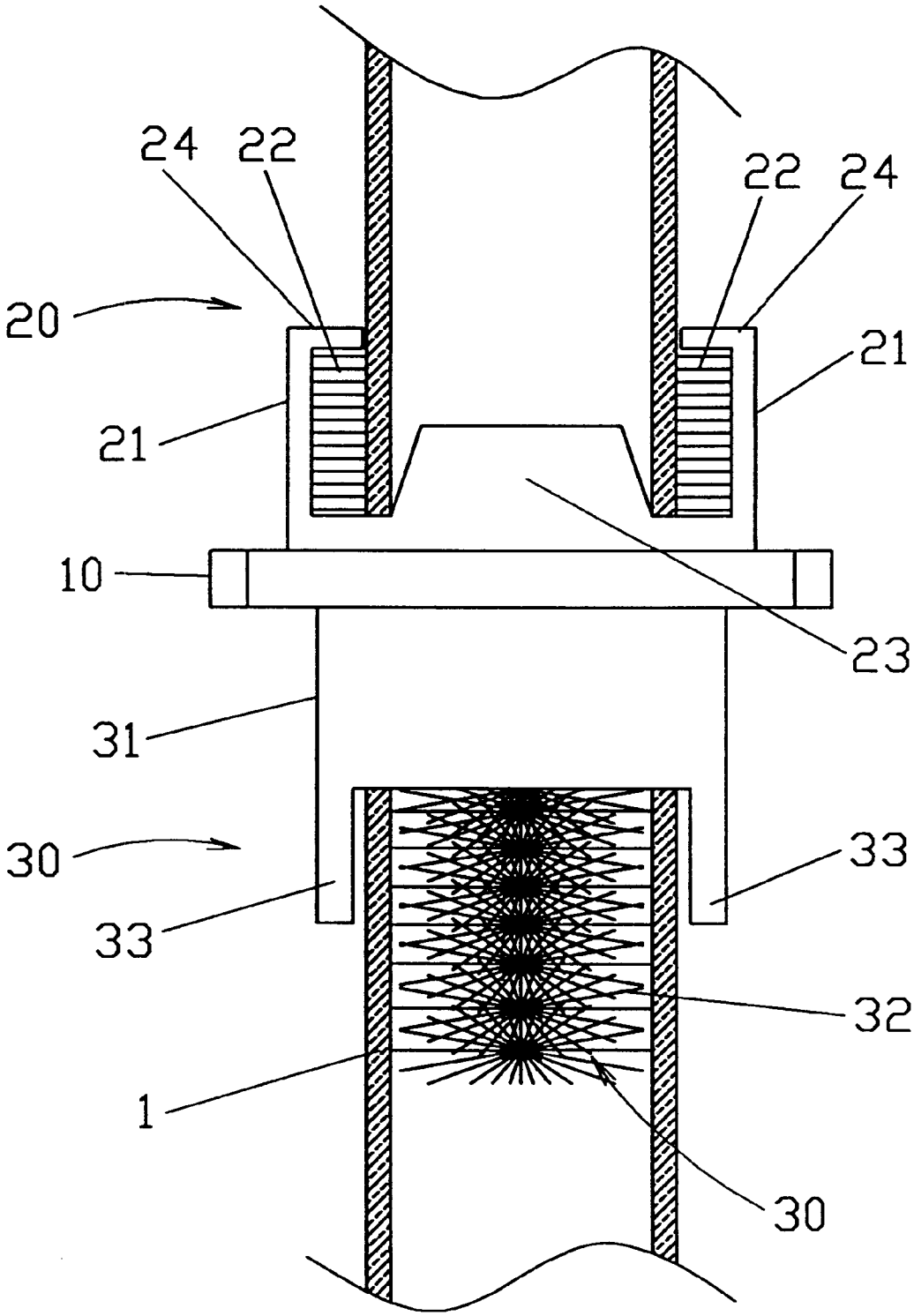
FIG. 5 is a side view of the tool of FIG. 1.

Female brush 20 is shown in more detail in FIG. 5. There is a circular wall 21 containing a cylindrical set of hard brush wires 22. There is an upper annular lip 24 to guide pipe end 1 into female brush 20. Brush wires 22 are directed in the same radial direction and collectively define an internal diameter that is slightly less than the outer diameter of pipe end 1. Lip 24 has an internal diameter which is slightly more than the outer diameter of pipe end 1. Accordingly, a firm friction fit is created when pipe end 1 is placed within female brush 20, within female brush 20 is a central, frusto-conical guide projection 23, to facilitate the entrance and placement of pipe end 1 within female brush 20. On the outside of the frusto-conical guide there is a cleaning or deburing surface for cleaning or deburing the inside of pipe end 1.

Male brush 30 and female brush 20 are disposed on the opposed sides of member 10. The outer diameter of male brush 30 is slightly larger than then inner diameter of pipe end 1. Male brush 30 has a pedestal 31 on which hard brush wires 32 are disposed. Abutting pedestal 31, the terminal of pipe end 1 is disposed a small distance from member 10. Pedestal 31 has a circular lip 33 to guide the manual placement of pipe end 1 onto pedestal 31. Brush wires 32 collectively have an outer diameter which is slightly larger than the internal diameter of pipe end 1.

In the above illustrated explanation, female brush 20 and male brush 30 are offset from each other in a direction transverse to member 10. One advantage of this configuration is that the thumb or other part of one hand can be placed on surface 10*a* proximate female brush 20 and opposite of brush 30 to provide stability as pipe end 1 is loaded onto brush 30. In another embodiment of tool 5 (shown in plan view in FIG. 6), female brush 20 and male brush 30 are aligned in a direction transverse to member 10.

It will be appreciated that different combinations of brushes 20 and/or 30 are possible. For example, instead of the illustrated female brush 20 and opposed male brush 30, end portion 10*d* may have two opposed female brushes 20 (not shown) or two opposed male brushes 30 (not shown). This permits two differently sized male brushes or two differently sized female brushes to be usefully available in certain applications.

Figure 6:
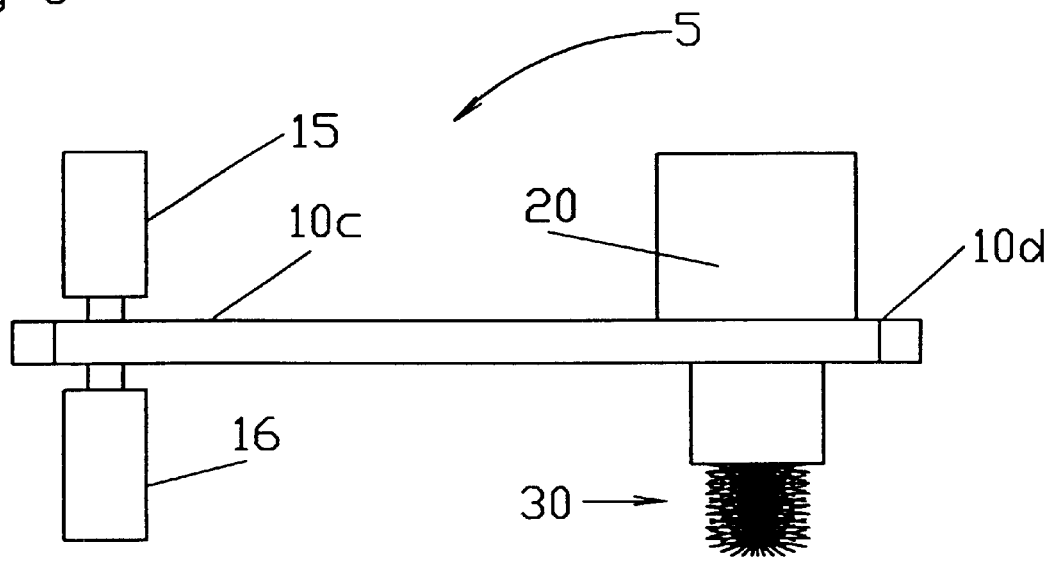
FIG. 6 is a side view of another embodiment of the tool of FIG. 1.
Figure 7:
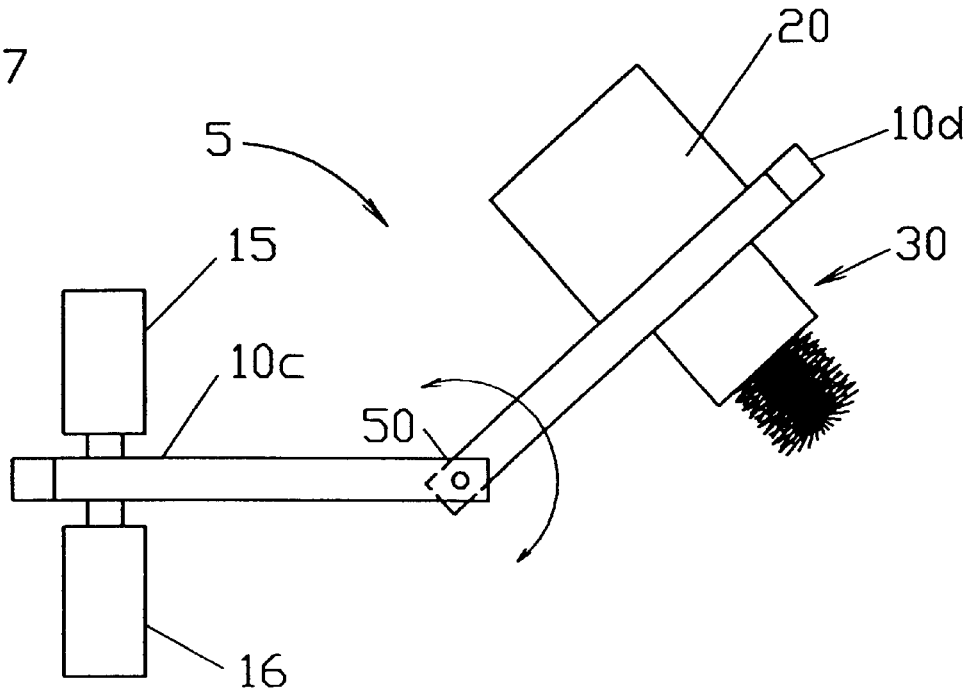
FIG. 7 is a side view of another embodiment of the tool.

Another embodiment of tool 5 is shown in FIG. 7, wherein end portion 10*c* is angularly movable with respect to end portion 10*d* by operation of intermediate hinge 50. This allows for a wider application of tool 5. For example, tool 5 of FIG. 7 permits the cleaning of pipe end 1 which is fixed in a crowded environment; e.g. an environment that does not permit complete rotation of end portion 10*c* about end portion 10*d* (whose male brush 30 is placed in pipe end 1) as contemplated by the versions shown in FIGS. 1–6.

Figures 8A, 8B, 8C, 9, 10:
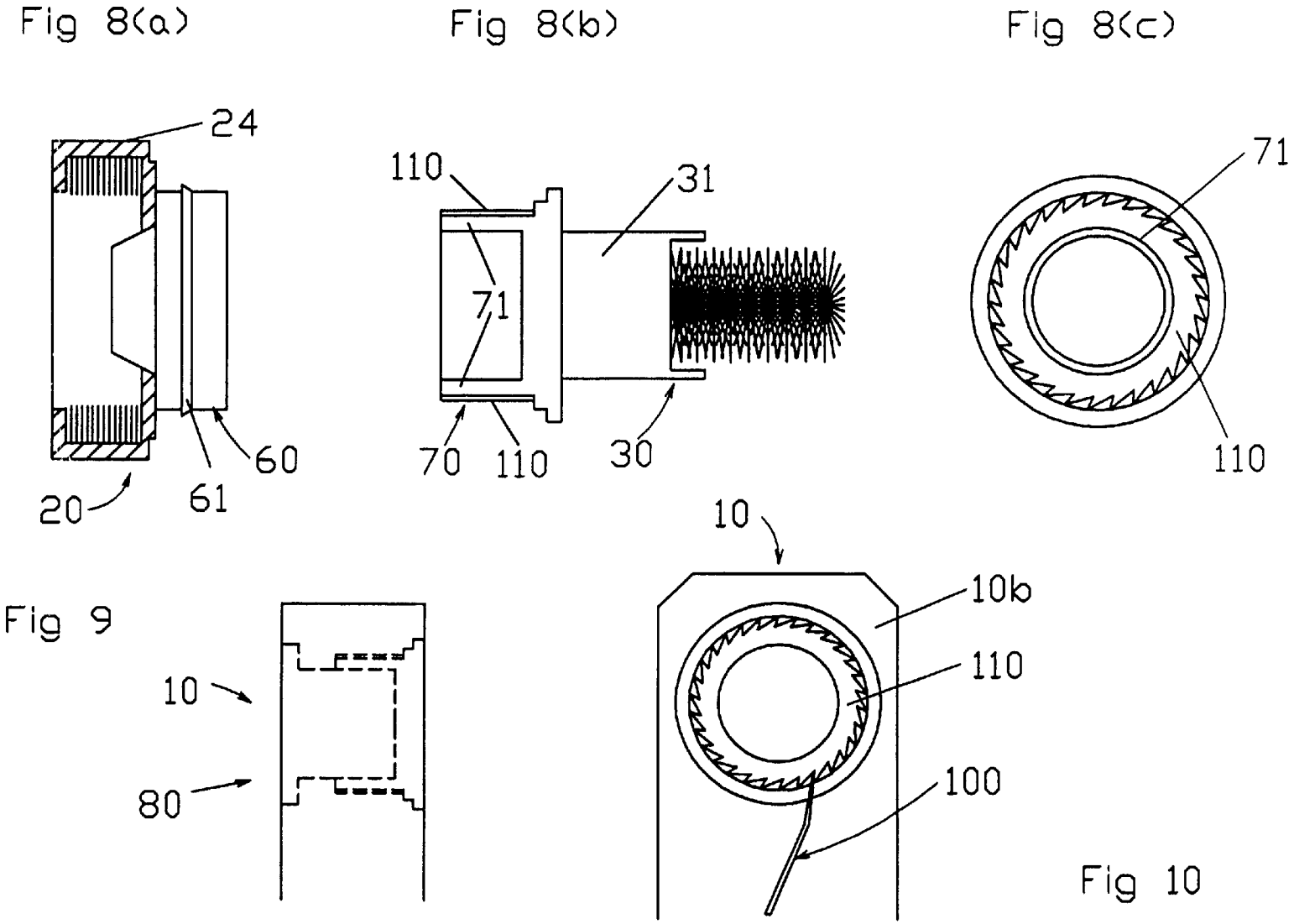
FIG. 9 is a partial side view of another embodiment of the tool.
FIG. 10 is a partial bottom plan view of another embodiment of the tool.

Another embodiment of tool 5 is shown in FIGS. 8–11, wherein brushes 20 and 30 are detachable from member 10. In FIGS. 8–11, reference numerals which are identical to those of FIGS. 1–6 represent similar or identical elements, except where the context otherwise indicates. The main difference between brushes 20 and 30 of FIGS. 1–6 and brushes 20 and 30 of FIGS. 8–11 is their attachment to member 10. In FIGS. 8–11, brushes 20 and 30 are detachably connectable to each other and to member 10 with a snap lock mechanism. Female brush 20 has stem 60 with annular lip 61. Male brush 30 has annular stem 70, which has annular lip 71 having a profile that is complementary to lip 61 to create a conventional snap lock and unlock mechanism. As shown in FIG. 9, member 10 has a through hole 80 profiled to receive snugly stems 60 and 70 when attached as described above. When attached, the result (in side view) appears as shown in FIG. 6. Differently sized brushes of this detachable embodiment, may be employed to fit differently sized pipe ends 1. Optionally (as seen in FIGS. 8(*b*) and 8(*c*) and in conjunction with FIG. 10, explained below), male brush 30 may have gear 110.

Another embodiment of tool 5 is shown in FIG. 10 to facilitate rotational movement of tool 5 about pipe end 1 which is fixed in a crowded environment (e.g. as contemplated by the embodiment shown in FIG. 7). As seen in FIG. 8(*c*), gear 110 is disposed on the outer surface of stem 70 and when brushes 20 and 30 are attached, as explained above, the teeth of gear 110 of male brush 30 are exposed above surface 10*b*. Steel clip 100 is disposed on surface 10*b* to engage gear 110 in a conventional ratchet-type mechanism. A variation is where female brush 20 has gear 110 (not shown).

Figure 13:
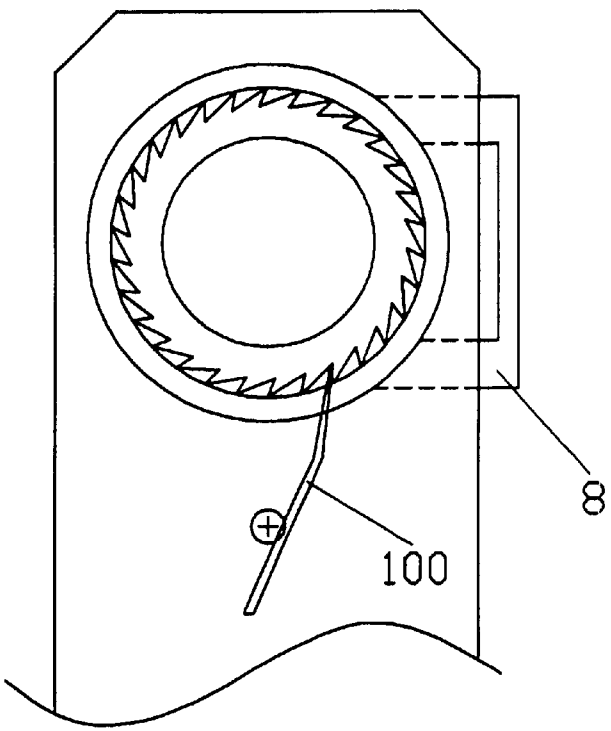
FIG. 13 is a top plan view of another embodiment of the male brush of the tool.
Figure 12:
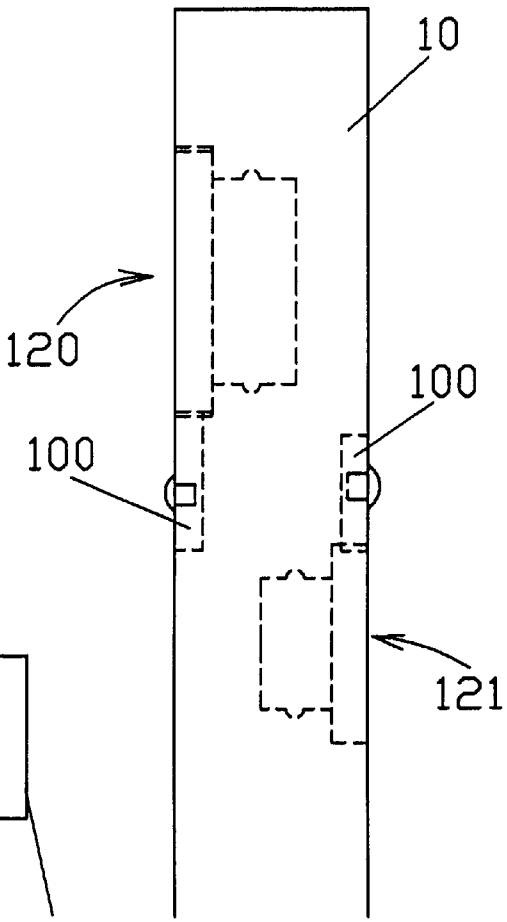
FIG. 12 is a partial side view of another embodiment
Figure 11A:
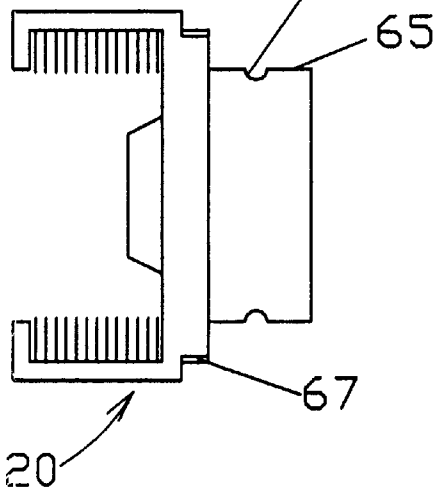
FIG. 11(*a*) is a partial sectional view of another embodiment of the female brush of the tool.
Figure 11B:
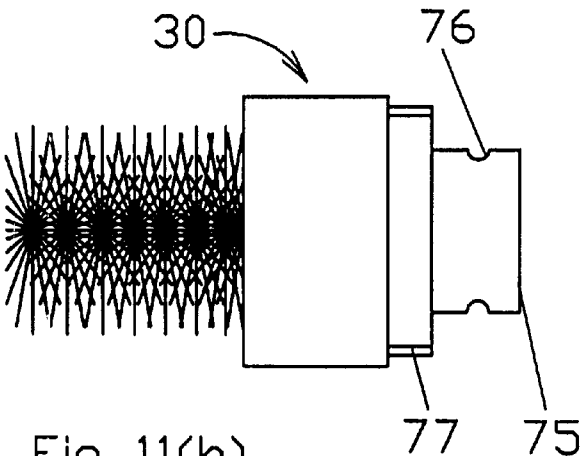

In another embodiment of tool 5, female brush 20 has stem 65 with annular channel 66, and gear 67 (as shown in FIG. 11(*a*)) and male brush 30 has stem 75 with annular channel 76, and gear 77. As shown in FIG. 12, member 10 has blind hole 120 profiled to snugly receive stem 65 in a friction fit. Proximate to hole 120, there is embedded within surface 10*a*, an associated clip 100 to create a ratchet type mechanism (as explained for FIG. 11). Also shown in FIG. 12, member 10 has blind hole 121 profiled to snugly receive in a friction fit stem 75. Proximate to blind hole 121, there is embedded within surface 10*b*, an associated clip 100 to create a ratchet type mechanism. To lock stems 65 or 75 in place, member 10 has on its side, two blind holes profiled to receive U-shaped key 80 in a friction fit, to engage annular channel 66 or 76, as the case may be, and to prevent the escape of stems 65 or 75 from their respective blind holes 120 or 121, as shown in FIG. 13.

Tool 5 is made of rigid material (typically metal or plastic). Brushes 20 and 30 are conventionally made and attached to tool 5 as described above. Hinge 50 is conventional.

For a ½" pipe end, the following may be acceptable dimensions for tool 5. Female brush is about 2.5 cm (1") high, and the diametrical separation from opposed brush wires (i.e. internal diameter defined) is about 1.25 cm (½"), and the internal diameter of lip 24 is slighter larger than that. Female brush is about 2.5 cm (1") high. Male brush 30 is about 1.875 cm (¾") high and has diameter of about 1.56 cm. Lip 33 is about 0.3 cm (⅛") thick.

It will be appreciated that the dimensions given are merely for purposes of illustration and are not limiting in any way. The specific dimensions given may be varied in practising this invention, depending on the specific application.

While the principles of the invention have now been made clear in the illustrated embodiments, there will be immediately obvious to those skilled in the art, many modifications of structure, arrangements, proportions, the elements, materials and components used in the practice of the invention, and otherwise, which are particularly adapted for specific environments and operational requirements without departing from those principles. The claims are therefore intended to cover and embrace such modifications within the limits only of the true spirit and scope of the invention.

What is claimed is:

1. A hand tool for cleaning the end of a pipe comprising:

(a) a longitudinal member having first and second opposed end portions and first and second opposed longitudinal sides;

(b) a first grippable member and a second grippable member both rotatably connected to said first end portion on said first and said second longitudinal sides respectively;

(c) a first cleaning member connected to said second end portion on said first longitudinal side for receiving a pipe end in a direction transverse to said longitudinal member; and (d) a second cleaning member connected to said second end portion on said second longitudinal side for receiving a pipe end in a direction transverse to said longitudinal member.

2. The hand tool of claim 1, wherein one of said first or said second cleaning members comprises a cylindrical female brush for receiving the pipe end.

3. The hand tool of claim 2, further comprising a guide member disposed centrally within said female brush for guiding the pipe end into and maintaining the pipe end in place relative to said female brush.

4. The hand tool of claim 3, wherein said guide member comprises a cylindrical projection with a downwardly bevelled wall.

5. The hand tool of claim 4, wherein said female brush has a plurality of wires disposed in an annular configuration, and said wires are directed radially inwardly.

6. The hand tool of claim 3, wherein the surface of said guide member comprises a deburing surface.

7. The hand tool of claim 6, wherein said female brush has a plurality of wires disposed in an annular configuration, and said wires are directed radially inwardly.

8. The hand tool of claim 3, wherein said female brush has a plurality of wires disposed in an annular configuration, and said wires are directed radially inwardly.

9. The hand tool of claim 2, wherein said female brush has a plurality of wires disposed in an annular configuration, and said wires are directed radially inwardly.

10. The hand tool of claim 2, wherein said first cleaning member and said second cleaning member are coaxially aligned in a direction transverse to said longitudinal member.

11. The hand tool of claim 1, wherein one of said first or said second cleaning members comprises a cylindrical male brush for fitting into the pipe end.

12. The hand tool of claim 11, further comprising a pedestal to which said cylindrical male brush is disposed.

13. The hand tool of claim 12, wherein said pedestal has a circular lip for guiding the outer surface of the pipe end over said male brush.

14. The hand tool of claim 11, wherein said first cleaning member and said second cleaning member are coaxially aligned in a direction transverse to said longitudinal member.

15. The hand tool of claim 1, wherein said first cleaning member and said second cleaning member are coaxially aligned in a direction transverse to said longitudinal member.

16. The hand tool of claim 1, wherein said first cleaning member is axially offset from said second cleaning member in a direction transverse to said longitudinal member.

17. The hand tool of claim 1, wherein one of said first or second cleaning members is detachably attached to said second longitudinal member.

18. The hand tool of claim 1, wherein one of said first or second cleaning members is rotatable in radial increments relative to said first or second longitudinal side respectively by a ratchet mechanism.

19. The hand tool of claim 1, further comprising pivot means, disposed between said first and second end portions, for permitting said first and second end portions to be pivoted and disposed at an oblique angle to each other.

20. The hand tool of claim 2 or 11, wherein one of said first or second cleaning members is detachably attached to said second longitudinal member.

* * * * *